US010090129B1

(12) United States Patent
Maloney

(10) Patent No.: US 10,090,129 B1
(45) Date of Patent: Oct. 2, 2018

(54) HOUSING ASSEMBLY FOR AN ELECTRICAL SWITCH

(71) Applicant: EATON CORPORATION, Cleveland, OH (US)

(72) Inventor: James G. Maloney, Industry, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/635,665

(22) Filed: Jun. 28, 2017

(51) Int. Cl.

| | |
|---|---|
| ***H01H 71/02*** | (2006.01) |
| ***H01R 13/514*** | (2006.01) |
| ***H01H 69/00*** | (2006.01) |
| *H01R 13/502* | (2006.01) |

(52) U.S. Cl.
CPC ..... *H01H 71/0207* (2013.01); *H01H 69/00* (2013.01); *H01R 13/502* (2013.01); *H01R 13/514* (2013.01)

(58) Field of Classification Search
CPC .. H01H 71/02; H01H 2071/0241; H01H 9/02; H01R 9/223; H01R 13/501; H01R 13/502; H01R 13/506; H01R 13/508; H01R 13/512; H01R 13/514; H05K 5/0013; H05K 5/0217; H05K 5/0239
See application file for complete search history.

(56) References Cited

U.S. PATENT DOCUMENTS

| | | | | |
|---|---|---|---|---|
| 6,635,833 | B2 * | 10/2003 | Vignaud | H01H 21/28 200/293 |
| 7,569,784 | B2 | 8/2009 | Rakus et al. | |
| 7,646,269 | B2 | 1/2010 | Weister et al. | |
| 7,683,276 | B2 | 3/2010 | Weister et al. | |

* cited by examiner

*Primary Examiner* — Vanessa Girardi
(74) *Attorney, Agent, or Firm* — Eckert Seamans

(57) ABSTRACT

A housing assembly is for an electrical switching apparatus. The housing assembly includes a base, a cover, and only one single coupling member extending through the base and the cover in order to couple the base to the cover.

11 Claims, 3 Drawing Sheets

HOUSING ASSEMBLY FOR AN ELECTRICAL SWITCH

CROSS-REFERENCE TO RELATED APPLICATION

This application is related to commonly assigned, concurrently filed U.S. patent application Ser. No. 15/635,681, filed Jun. 28, 2017, and entitled "MULTI-POLE ELECTRICAL SWITCHING APPARATUS AND TRIP CAM ASSEMBLY THEREFOR".

BACKGROUND

Field

The disclosed concept relates generally to electrical switching apparatus such as, for example, circuit breakers. The disclosed concept also relates to housing assemblies for electrical switching apparatus. The disclosed concept also relates to methods of assembling an electrical switching apparatus.

Background Information

Electrical switching apparatus, such as circuit breakers, are employed in diverse capacities in power distribution systems. A circuit breaker may include, for example, a fixed contact and a movable contact, with the movable contact being movable into and out of electrically conductive engagement with the fixed contact. This switches the circuit breaker between an ON or closed position and an OFF or open position, or between the ON or closed position and a tripped or tripped OFF position. The circuit breaker may also include an operating mechanism for opening and closing the separable contacts, and a housing assembly for enclosing the separable contacts and the operating mechanism.

Housing assemblies of miniature circuit breakers, for example, typically include a base and a cover coupled to the base. A known problem with such housing assemblies is that they require a plurality of coupling members (e.g., without limitation, rivets) to couple the base to the cover. Employing numerous coupling members increases the cost and complexity of the circuit breaker.

There is, therefore, room for improvement in electrical switching apparatus and in housing assemblies therefor.

There is also room for improvement in methods of assembling electrical switching apparatus.

SUMMARY

These needs and others are met by embodiments of the disclosed concept, which are directed to an electrical switching apparatus, and housing assembly and assembling method therefor.

As one aspect of the disclosed concept, a housing assembly is provided for an electrical switching apparatus. The housing assembly includes a base, a cover, and only one single coupling member extending through the base and the cover in order to couple the base to the cover.

As another aspect of the disclosed concept, an electrical switching apparatus is provided. The electrical switching apparatus includes a pair of separable contacts, an operating mechanism for opening and closing the pair of separable contacts, and the aforementioned housing assembly. The base and the cover cooperatively enclose the pair of separable contacts and the operating mechanism.

As yet another aspect of the disclosed concept, a method of assembling an electrical switching apparatus is provided. The electrical switching apparatus has a pair of separable contacts and an operating mechanism for opening and closing the pair of separable contacts. The method includes the steps of providing a housing assembly with the electrical switching apparatus, the housing assembly comprising a base and a cover each comprising a body portion and at least one latching portion extending outwardly from the body portion, each corresponding body portion having an edge portion defining a thru hole; overlaying the cover onto the base such that the latching portion of the cover is disposed adjacent the latching portion of the base, the base and the cover cooperatively enclosing the pair of separable contacts and the operating mechanism; sliding the cover laterally with respect to the base such that the edge portion of the base and the edge portion the cover move into alignment with each other; and inserting only one single coupling member through the base and the cover, the coupling member extending through the edge portion of the base and the edge portion of the cover in order to couple the base to the cover.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "coupled" together shall mean that the parts are joined together either directly or joined through one or more intermediate parts.

As employed herein, the statement that two or more parts or components "engage" one another shall mean that the parts exert a force against one another either directly or through one or more intermediate parts or components.

As employed herein, the term "coupling member" refers to any suitable connecting or tightening mechanism expressly including, but not limited to, rivets, screws, bolts, the combination of bolts and nuts (e.g., without limitation, lock nuts), washers and nuts, zip ties, and wires ties. "Coupling members" as defined herein refer to, for example and without limitation, members that are separable from, and not integral with, the components to which they are coupled.

Figure 1:
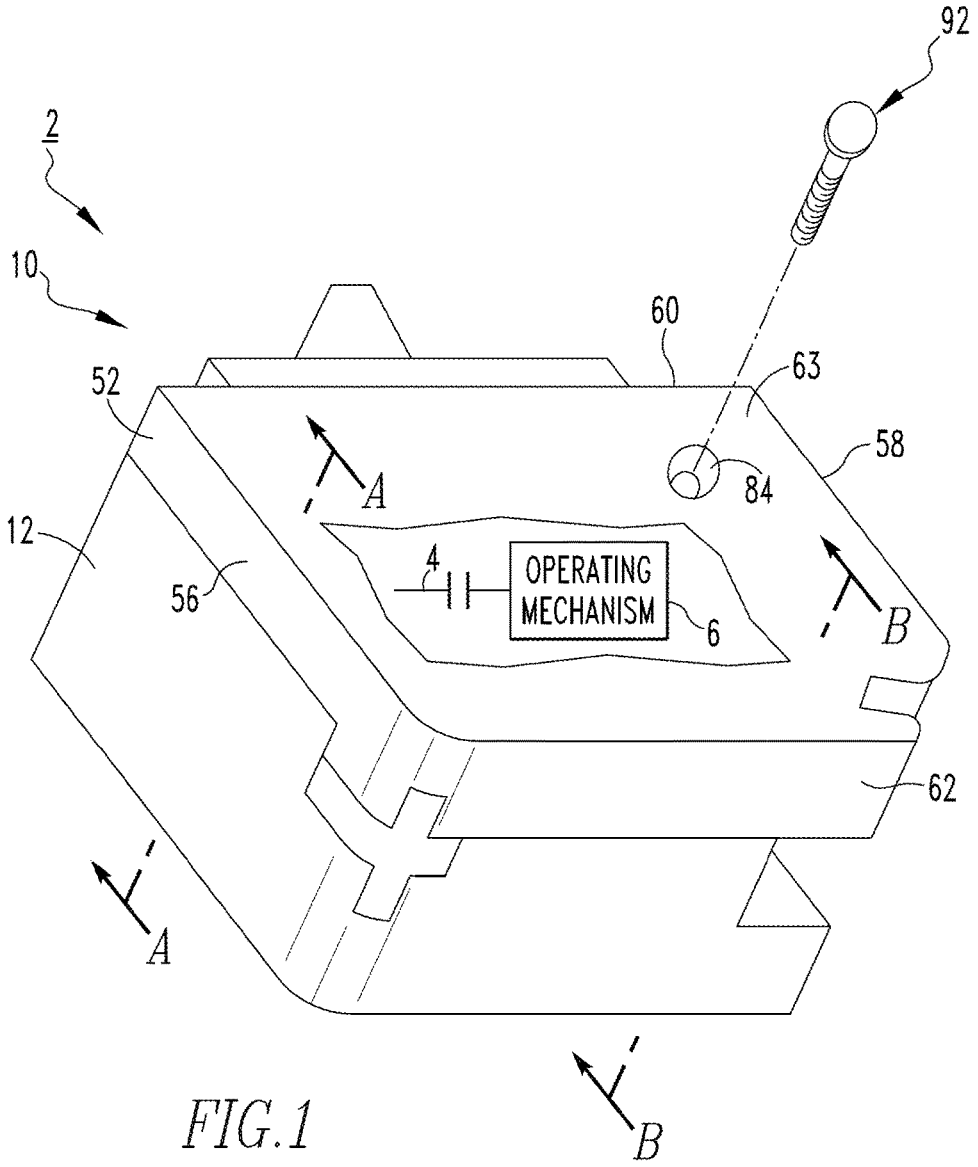
FIG. 1 is a simplified view of an electrical switching apparatus and housing assembly therefor, shown with a coupling member exploded, and shown with a portion cutaway in order to see hidden structures, in accordance with one non-limiting embodiment of the disclosed concept.

FIG. 1 is a simplified view of an electrical switching apparatus (e.g., without limitation, miniature circuit breaker 2), in accordance with one non-limiting embodiment of the disclosed concept. The example circuit breaker 2 includes a pair of separable contacts 4 (shown in simplified form), an operating mechanism 6 (shown in simplified form) for opening and closing the separable contacts 4, and a novel housing assembly 10. The housing assembly 10 includes a base 12 and a cover 52 that cooperatively enclose the separable contacts 4 and the operating mechanism 6. As will be discussed in greater detail below, the housing assembly 10 further includes only one single coupling member 92 extending through the base 12 and the cover 52 in order to couple the base 12 to the cover 52. This is distinct from prior art housing assemblies (not shown) of circuit breakers which include a plurality of coupling members extending through bases and covers to couple the bases to the covers. As such, it will be appreciated herein that the circuit breaker 2 is less expensive to manufacture than prior art circuit breakers.

Figure 2:
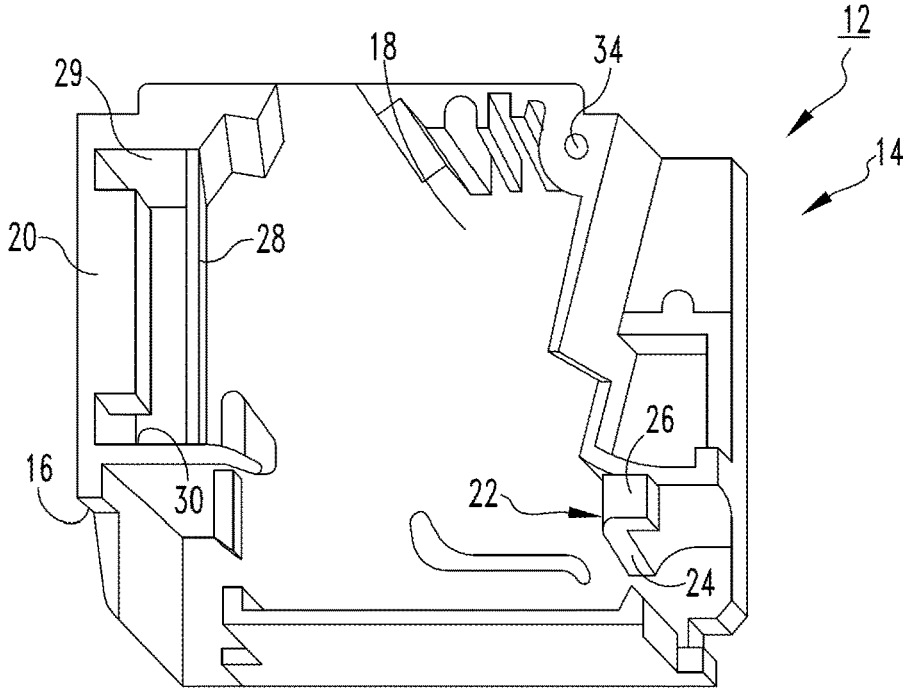
FIG. 2 is a top isometric view of a base for the electrical switching apparatus and housing assembly therefor of FIG. 1.
Figure 3:
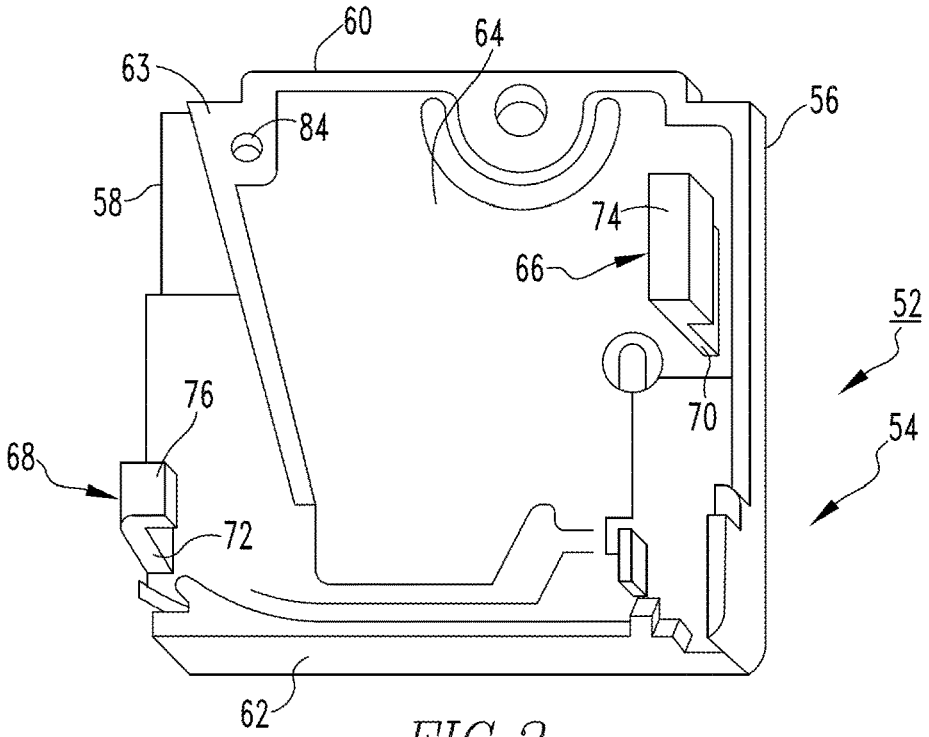
FIG. 3 is a top isometric view of a cover for the electrical switching apparatus and housing assembly therefor of FIG. 1.

FIG. 2 is a top isometric view of the base 12 and FIG. 3 is a top isometric view of the cover 52. In one example embodiment, the base 12 and the cover 52 are each unitary components made from a single piece of material. Referring to FIG. 2, the base 12 includes a body portion 14 having a generally rectangular-shaped peripheral portion 16 and a floor portion 18 located internal with respect to the peripheral portion 16. Additionally, the base 12 has a number of latching portions (see, for example, generally rectangular-shaped ledge 20 and latching portion 22) extending outwardly from the body portion 14. The ledge 20 extends from the peripheral 16 in a direction parallel with the floor portion 18. The latching portion 22 includes an extension portion 24 extending from the floor portion 18 in a direction generally perpendicular with the floor portion 18, and a hook portion 26 extending from the extension portion 24. The base 12 also includes a generally planar wall portion 28 extending from the floor portion 18 and being located generally perpendicular with respect to the floor portion 18. As shown in FIG. 2, the peripheral portion 16, the ledge 20, the wall portion 28, and a number of opposing internal surfaces 29,30 of the base 12 define a thru hole (e.g., to the left of the wall portion 28 in FIG. 2) in the base 12. It will be appreciated that this thru hole advantageously provides a mechanism to allow the base 12 to be manufactured by an injection molding process.

Referring to FIG. 3, the cover 52 includes a body portion 54 having first and second opposing peripheral edge portions 56,58, third and fourth opposing peripheral edge portions 60,62 that extend between the first and second peripheral edge portions 56,58, and a floor portion 64 extending between the peripheral edge portions 56,58,60,62. As shown, the cover 52 further includes a number of latching portions (two example latching portions 66,68 are shown in FIG. 3) extending outwardly from the floor portion 64. The latching portions 66,68 each include a corresponding extension portion 70,72 extending from and being located generally perpendicular with respect to the floor portion 64, and a corresponding hook portion 74,76 extending outwardly from the corresponding extension portion 70,72. The extension portion 70 extends from proximate the first peripheral edge portion 56, and the extension portion 72 extends from proximate the second peripheral edge portion 58. As shown in FIG. 3, the third peripheral edge portion 60 extends from the second peripheral edge portion 58 at a junction 63. It will be appreciated that the coupling member 92 (FIG. 1) extends through the cover 52 proximate the junction 63.

Continuing to refer to FIGS. 2 and 3, the body portion 14 of the base 12 has an edge portion 34 defining a thru hole, and the body portion 54 of the cover 52 has an edge portion 84 defining a thru hole. When the circuit breaker 2 and housing assembly 10 therefor is assembled, the edge portions 34,84 are aligned with (i.e., overlay and/or provide for a common passage through) each other and the coupling member 92 (FIG. 1) extends through the edge portions 34,84. Furthermore, when the circuit breaker 2 and housing assembly 10 therefor is assembled, the ledge 20 of the base 12 is interlocked with the latching portion 66 of the cover 52, and the latching portion 22 of the base 12 is interlocked with the latching portion 68 of the cover 52. It will be appreciated that this interlocking between the ledge 20 and the latching portion 66, and between the latching portions 22,68, advantageously eliminates the need for the circuit breaker 2 and housing assembly 10 therefor to have any coupling members in addition to the coupling member 92 (FIG. 1) extending through the base 12 and the cover 52.

Figure 4:
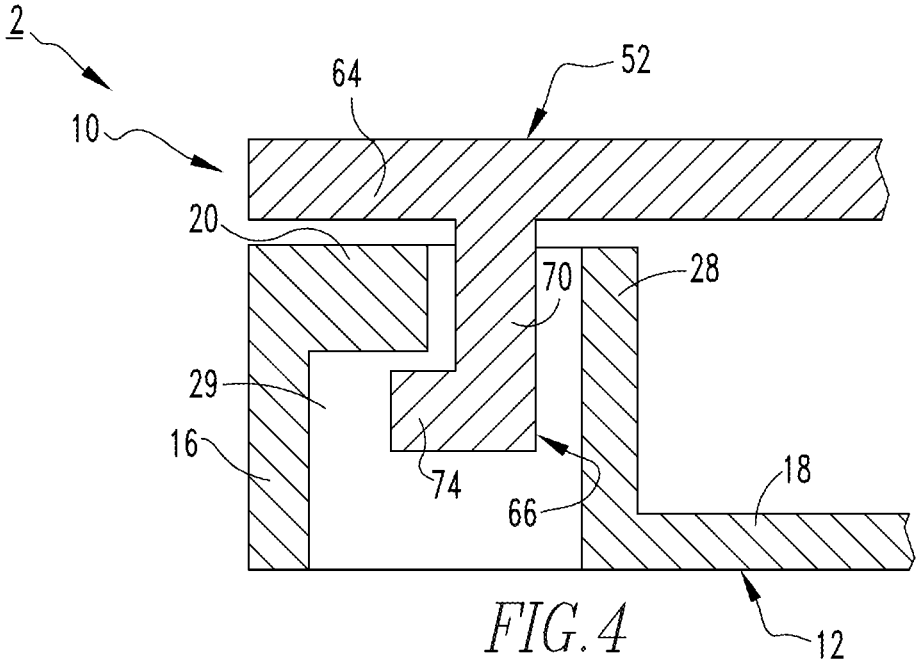
FIG. 4 is a section view of a portion of the electrical switching apparatus and housing assembly therefor of FIG. 1, taken along line A-A of FIG. 1.

More specifically, as shown in FIG. 4, the hook portion 74 of the latching portion 66 has been inserted into the thru hole of the base 12 (i.e., the thru hole defined by peripheral portion 16, ledge 20, wall portion 28, and surfaces 29,30 (FIG. 2)) and slid laterally (i.e., moved to the left with respect to the orientation of FIG. 4) with respect to the base 12. During assembly, once the latching portion 66 is in the position shown in FIG. 4, the coupling member 92 (FIG. 1) is inserted through the edge portions 34,84. This minimizes and/or eliminates side to side movement of the cover 52 with respect to the base 12. As such, the hook portion 74 provides a mechanism to maintain the relative position of the cover 52 with respect to the base 12. That is, if the cover 52 is caused to move upwards (with respect to the orientation of FIG. 4), or away from the base 12, the hook portion 74 will press into the ledge 20 in order to prevent such separation of components. When side to side movement of the cover 52 and the base 12 is restricted and/or minimized by the coupling member 92 (FIG. 1), this relationship between the hook portion 74 and the ledge 20 is what is meant by the two components being "interlocked" with each other.

Stated differently, a portion of the ledge 20 is located between the hook portion 74 and the floor portion 64 of the cover 52. Furthermore, the ledge 20 extends from the peripheral portion 16 toward the wall portion 28. The extension portion 70 is located between the wall portion 28 and the ledge 20. The ledge 20 is located generally perpendicular with respect to the peripheral portion 16. The hook portion 74 is located generally perpendicular with respect to the extension portion 70. As a result, when the coupling member 92 (FIG. 1) is extended through the base 12 and the cover 52, the ledge 20 and the latching portion 66 provide for a relatively secure connection point, a connection point which replaces the need for at least one coupling member, thereby reducing the overall cost of the circuit breaker 2 and housing assembly 10 therefor.

Also shown in FIG. 4, the wall portion 28 of the base 12 extends from the floor portion 18 of the base 12 to proximate the floor portion 64 of the cover 52. As a result, it will be appreciated that the wall portion 28 advantageously functions as a barrier to protect operators from potential exposure to live and/or energized components (not shown) located within the circuit breaker 2. As such, while the thru hole defined by peripheral portion 16, ledge 20, wall portion 28, and surfaces 29,30 allows for the base 12 to be manufactured via injection molding, the wall portion 28 functions to enclose a side of the circuit breaker 2 proximate the ledge 20 so that the potential for contact with live and/or energized components (not shown) within the circuit breaker 2 is relatively low.

Figure 5:
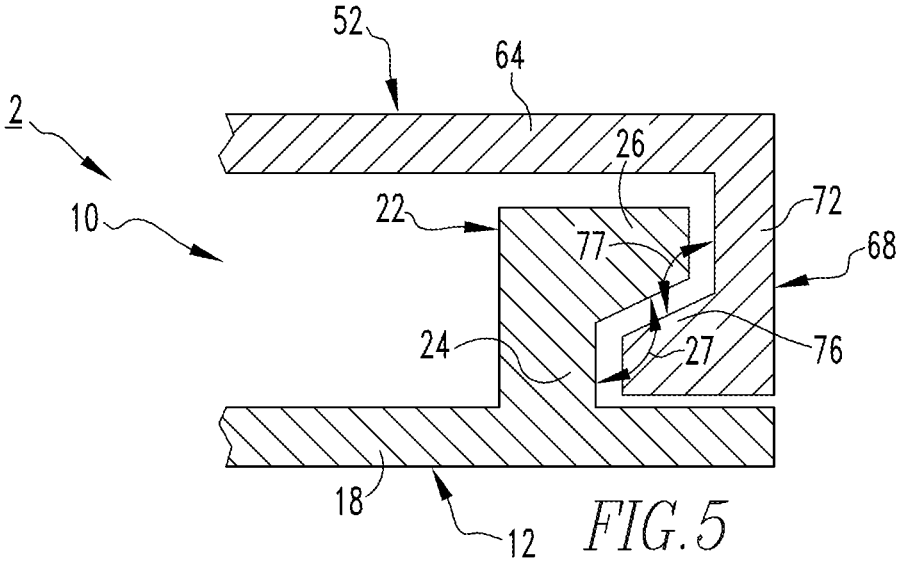
FIG. 5 is a section view of another portion of the electrical switching apparatus and housing assembly therefor of FIG. 1, taken along line B-B of FIG. 1.

Similar to the interlocking of the ledge 20 and the latching portion 66, the latching portion 22 of the base 12 is interlocked with the latching portion 68 of the cover 52, as shown in FIG. 5. That is, if the cover 52 is caused to move upwards (with respect to the orientation of FIG. 5), or away from the base 12, the hook portion 76 will press into the hook portion 26 in order to prevent such separation of components. Stated differently, a portion of the hook portion 26 of the base 12 is located between the hook portion 76 of the cover 52 and the floor portion 64 of the cover 52. Accordingly, the interlocking between the latching portions 22,68 functions as a relatively secure connection point, a connection point which replaces the need for at least one coupling member, thereby reducing the cost of the circuit breaker 2.

As mentioned above, the circuit breaker 2 and housing assembly 10 therefor includes only (i.e., no more than) the one single coupling member 92 extending through the base 12 and the cover 52. Prior art electrical switching apparatus (not shown), such as miniature circuit breakers, typically employ four coupling members to couple the base to the cover. This translates to a reduction in costs equal to the cost of three coupling members per circuit breaker. By way of one non-limiting example, if the coupling members are rivets that cost $0.0096/rivet, this translates into a cost savings of $0.0288/miniature circuit breaker (i.e., ($0.0096/rivet) times three rivets removed per miniature circuit breaker). It will be appreciated, therefore, that when large volumes of circuit breakers are manufactured, this cost savings is significant.

Continuing to refer to FIG. 5, it will be appreciated that the hook portions 26,76 each extend at corresponding obtuse angles 27,77 from their corresponding extension portions 24,72. As a result, assembly of the circuit breaker 2 and housing assembly therefor is simplified in that the interlocking of the latching portions 22,68 can be accomplished with a degree of forgiveness. That is, when the cover 52 slides laterally with respect to the base 12 during assembly, the hook portion 76 does not need to fit exactly under the hook portion 26, but rather is provided with some tolerance by virtue of the fact that the hook portions 26,76 extend at obtuse angles 27,77 from the extension portions 24,72.

It will thus be appreciated that a method of assembling the electrical switching apparatus 2 includes the steps of providing a housing assembly 10 with the electrical switching apparatus 2, the housing assembly 10 having a base 12 and a cover 52 each comprising a body portion 14,54 and at least one latching portion 20,22,66,68 extending outwardly from the body portion 14,54, each corresponding body portion 14,54 having an edge portion 34,84 defining a thru hole; overlaying the cover 52 onto the base 12 such that the at least one latching portion 66,68 of the cover 52 is located adjacent the at least one latching portion 20,22 of the base 12, the base 12 and the cover 52 cooperatively enclosing the pair of separable contacts 4 and the operating mechanism 6; sliding the cover 52 laterally with respect to the base 12 such that the edge portion 34 of the base 12 and the edge portion 84 the cover 52 move into alignment with each other; and inserting only one single coupling member 92 through the base 12 and the cover 52, the coupling member 92 extending through the edge portion 34 of the base 12 and the edge portion 84 of the cover 52 in order to couple the base 12 to the cover 52. The method may further include the step of sliding the cover 52 such that at least a portion of the at least one latching portion 20,22 of the base 12 is disposed between the hook portion 74,76 and the body portion 54 of the cover 52.

Although the disclosed concept has been described in association with the ledge 20 being interlocked with the latching portion 66, and the latching portions 22,68 being interlocked with each other, it will be appreciated that latching portions (not shown) having suitable alternative shapes, location, size and/or orientation are contemplated herein.

Accordingly, it will be appreciated that the disclosed concept provides for an improved (e.g., without limitation, less expensive to manufacture) electrical switching apparatus 2, and housing assembly 10 and assembling method therefor, in which only one single coupling member 92 is employed to couple a base 12 and a cover 52 of the housing assembly 10 together.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A housing assembly for an electrical switching apparatus, said housing assembly comprising:

a base;

a cover; and only one single coupling member extending through said base and said cover in order to couple said base to said cover, wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said body portion of said base comprises a peripheral portion and a floor portion disposed generally internal with respect to said peripheral portion; wherein said base further comprises a wall portion extending from said floor portion to proximate said body portion of said cover; wherein said at least one latching portion of said base comprises a ledge extending from said peripheral portion toward said wall portion; and wherein said extension portion of one of said at least one latching portion of said cover is disposed between said wall portion and said ledge.

2. The housing assembly of claim 1 wherein said base is a first unitary component made from a single piece of material; and wherein said cover is a second unitary component made from a single piece of material.

3. A housing assembly for an electrical switching apparatus, said housing assembly comprising:

a base;

a cover; and only one single coupling member extending through said base and said cover in order to couple said base to said cover, wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said at least one latching portion of said base comprises a first latching portion and a second latching portion; wherein said at least one latching portion of said cover comprises a third latching portion and a fourth latching portion; wherein said first latching portion is interlocked with said third latching portion; wherein said second latching portion is interlocked with said fourth latching portion; wherein said hook portion of said third latching portion is disposed generally perpendicular to said extension portion of said third latching portion; and wherein said hook portion of said fourth latching portion extends at an obtuse angle from said extension portion of said fourth latching portion.

4. The housing assembly of claim 3 wherein said body portion of said base comprises a peripheral portion and a floor portion disposed generally internal with respect to said peripheral portion; wherein said body portion of said cover comprises a floor portion; wherein said extension portion of said third latching portion and said extension portion of said fourth latching portion extend from said floor portion of said cover; wherein said first latching portion extends from said peripheral portion in a direction parallel with said floor portion of said base; and wherein said second latching portion extends from said floor portion of said base in a direction generally perpendicular with said floor portion of said base.

5. The housing assembly of claim 3 wherein said body portion of said cover comprises a first peripheral edge portion, a second peripheral edge portion opposite and distal the first peripheral edge portion, a third peripheral edge portion extending between the first and second peripheral edge portions, and a fourth peripheral edge portion opposite and distal the third peripheral edge portion and extending between the first and second peripheral edge portions; wherein said extension portion of said third latching portion extends from proximate the first peripheral edge portion; wherein said extension portion of said fourth latching portion extends from proximate the second peripheral edge portion; wherein the third peripheral edge portion extends from the second peripheral edge portion at a junction; and wherein said coupling member extends through said cover proximate the junction.

6. A housing assembly for an electrical switching apparatus, said housing assembly comprising:

a base;

a cover; and only one single coupling member extending through said base and said cover in order to couple said base to said cover, wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said at least one latching portion of said base comprises a first latching portion and a second latching portion; wherein said at least one latching portion of said cover comprises a third latching portion and a fourth latching portion; wherein said first latching portion is interlocked with said third latching portion; wherein said second latching portion is interlocked with said fourth latching portion; wherein said first latching portion is a generally rectangular-shaped ledge extending outwardly from said body portion of said base; wherein said second latching portion comprises an extension portion and a hook portion extending at an obtuse angle from said extension portion of said second latching portion; and wherein said extension portion of said second latching portion extends outwardly from said body portion of said base.

7. An electrical switching apparatus comprising:

a pair of separable contacts;

an operating mechanism for opening and closing said pair of separable contacts; and a housing assembly comprising:

a base, a cover, and only one single coupling member extending through said base and said cover in order to couple said base to said cover, wherein said base and said cover cooperatively enclose said pair of separable contacts and said operating mechanism; wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said body portion of said base comprises a peripheral portion and a floor portion disposed generally internal with respect to said peripheral portion; wherein said base further comprises a wall portion extending from said floor portion to proximate said body portion of said cover; wherein said at least one latching portion of said base comprises a ledge extending from said peripheral portion toward said wall portion; and wherein said extension portion of one of said at least one latching portion of said cover is disposed between said wall portion and said ledge.

8. An electrical switching apparatus comprising:

a pair of separable contacts;

an operating mechanism for opening and closing said pair of separable contacts; and a housing assembly comprising:

a base, a cover, and only one single coupling member extending through said base and said cover in order to couple said base to said cover, wherein said base and said cover cooperatively enclose said pair of separable contacts and said operating mechanism; wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said at least one latching portion of said base comprises a first latching portion and a second latching portion; wherein said at least one latching portion of said cover comprises a third latching portion and a fourth latching portion; wherein said first latching portion is interlocked with said third latching portion; wherein said second latching portion is interlocked with said fourth latching portion; wherein said hook portion of said third latching portion is disposed generally perpendicular to said extension portion of said third latching portion; and wherein said hook portion of said fourth latching portion extends at an obtuse angle from said extension portion of said fourth latching portion.

9. The electrical switching apparatus of claim 8 wherein said body portion of said base comprises a peripheral portion and a floor portion disposed generally internal with respect to said peripheral portion; wherein said body portion of said cover comprises a floor portion; wherein said extension portion of said third latching portion and said extension portion of said fourth latching portion extend from said floor portion of said cover; wherein said first latching portion extends from said peripheral portion in a direction parallel with said floor portion of said cover; and wherein said second latching portion extends from said floor portion of said base in a direction generally perpendicular with said floor portion of said cover.

10. An electrical switching apparatus comprising:

a pair of separable contacts;

an operating mechanism for opening and closing said pair of separable contacts; and a housing assembly comprising:

a base, a cover, and only one single coupling member extending through said base and said cover in order to couple said base to said cover, wherein said base and said cover cooperatively enclose said pair of separable contacts and said operating mechanism; wherein said base comprises a body portion and at least one latching portion extending outwardly from said body portion; wherein said cover comprises a body portion and at least one latching portion extending outwardly from said body portion of said cover; wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said at least one latching portion of said base comprises a first latching portion and a second latching portion; wherein said at least one latching portion of said cover comprises a third latching portion and a fourth latching portion; wherein said first latching portion is interlocked with said third latching portion; wherein said second latching portion is interlocked with said fourth latching portion; wherein said first latching portion is a generally rectangular-shaped ledge extending outwardly from said body portion of said base; wherein said second latching portion comprises an extension portion and a hook portion extending at an obtuse angle from said extension portion of said second latching portion; and wherein said extension portion of said second latching portion extends outwardly from said body portion of said base.

11. A method of assembling an electrical switching apparatus, said electrical switching apparatus comprising a pair of separable contacts and an operating mechanism for opening and closing said pair of separable contacts, the method comprising the steps of:

providing a housing assembly with said electrical switching apparatus, said housing assembly comprising a base and a cover each comprising a body portion and at least one latching portion extending outwardly from said body portion, each corresponding body portion having an edge portion defining a thru hole;

overlaying said cover onto said base such that said at least one latching portion of said cover is disposed adjacent said at least one latching portion of said base, said base and said cover cooperatively enclosing said pair of separable contacts and said operating mechanism;

sliding said cover laterally with respect to said base such that the edge portion of said base and the edge portion said cover move into alignment with each other; and inserting only one single coupling member through said base and said cover, said coupling member extending through the edge portion of said base and the edge portion of said cover in order to couple said base to said cover, wherein said at least one latching portion of said base is interlocked with said at least one latching portion of said cover; wherein said at least one latching portion of said cover comprises an extension portion and a hook portion extending from said extension portion; wherein said extension portion extends from said body portion of said cover; wherein at least a portion of said at least one latching portion of said base is disposed between said hook portion and said body portion of said cover; wherein said body portion of said base comprises a peripheral portion and a floor portion disposed generally internal with respect to said peripheral portion; wherein said base further comprises a wall portion extending from said floor portion to proximate said body portion of said cover; wherein said at least one latching portion of said base comprises a ledge extending from said peripheral portion toward said wall portion; and wherein said extension portion of one of said at least one latching portion of said cover is disposed between said wall portion and said ledge.

* * * * *